US005992118A

United States Patent [19]

Wagner et al.

[11] Patent Number: 5,992,118

[45] Date of Patent: Nov. 30, 1999

[54] SEGMENT FOR LINING CAVITIES

[75] Inventors: Harald Wagner, Mauthausen; Alfred Schulter, Linz, both of Austria

[73] Assignee: GIT Tunnelbau GmbH, Pasching, Australia

[21] Appl. No.: 08/849,096

[22] PCT Filed: Sep. 27, 1996

[86] PCT No.: PCT/AT96/00174

§ 371 Date: Jun. 17, 1997

§ 102(e) Date: Jun. 17, 1997

[87] PCT Pub. No.: WO97/13054

PCT Pub. Date: Apr. 10, 1997

[30] Foreign Application Priority Data

| | | | |
|---|---|---|---|
| Sep. 29, 1995 | [AT] | Austria | 1616/95 |
| Dec. 14, 1995 | [AT] | Austria | 2029/95 |

[51] Int. Cl.[6] ..... E21D 11/08

[52] U.S. Cl. ..... 52/592.2; 405/153

[58] Field of Search ..... 52/585.1, 586.1, 52/765, 766, 774, 749.15, 590.2, 590.3, 405.2, 405.3, 405.4, 407.3, 419, 592.2, 396.01, 396.05, 396.08, 396.09, 513; 405/132, 259.6, 151, 152, 153

[56] References Cited

U.S. PATENT DOCUMENTS

| | | | |
|---|---|---|---|
| 3,780,484 | 12/1973 | Muse | 52/585.1 |
| 4,741,135 | 5/1988 | Baena | 52/585.1 X |
| 5,189,859 | 3/1993 | Payer | 52/585.1 |
| 5,232,302 | 8/1993 | Wagner et al. | 52/585.1 X |

FOREIGN PATENT DOCUMENTS

| | | |
|---|---|---|
| 528236 | 2/1957 | Belgium . |
| 2238792 | 2/1973 | Germany . |
| 2457427 | 6/1976 | Germany . |
| 52-153323 | 5/1951 | Japan . |
| 516049 | 1/1972 | Switzerland . |
| 654066 | 1/1986 | Switzerland . |

*Primary Examiner*—Michael Safavi

*Attorney, Agent, or Firm*—Watson Cole Grindle Watson, PLLC

[57] ABSTRACT

A segment for lining cavities, in particular tunnels, includes a substantially shell-shaped body bounded by an inner face, an outer face and side faces, with at least one opening in a side face for the purpose of receiving a dowel. The opening being configured as a substantially cylindrical bore into which projects a tube of limited deformability. A gap being provided between the outer circumference of the tube and the wall of the bore.

19 Claims, 8 Drawing Sheets

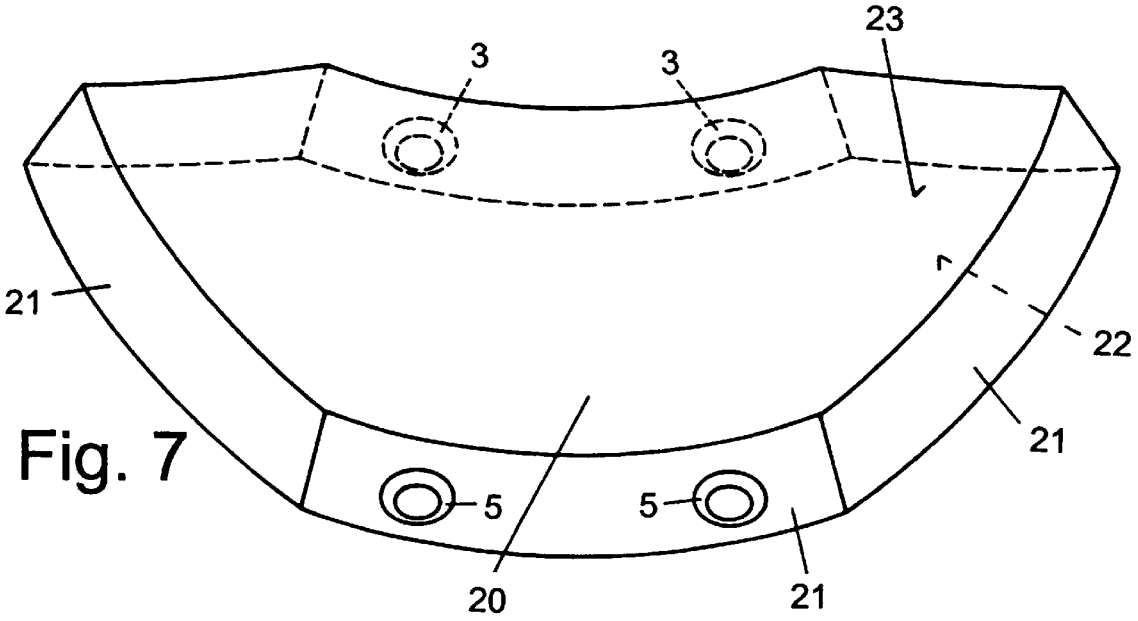
Fig. 7
Fig. 8
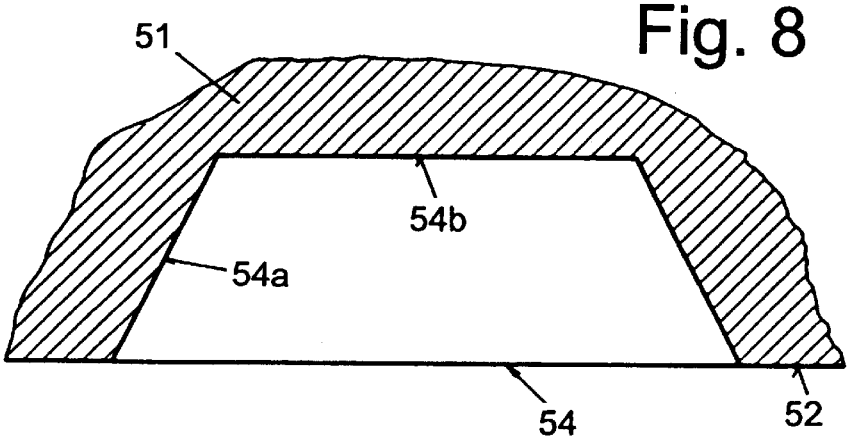
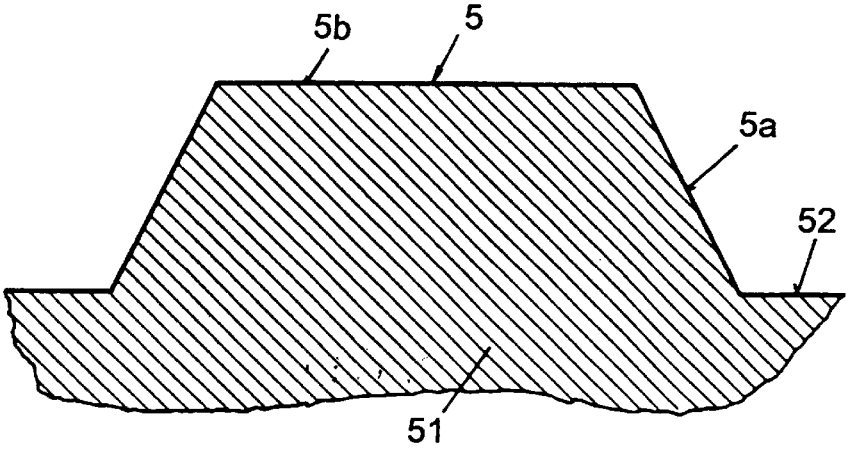
Fig. 9

Fig. 13
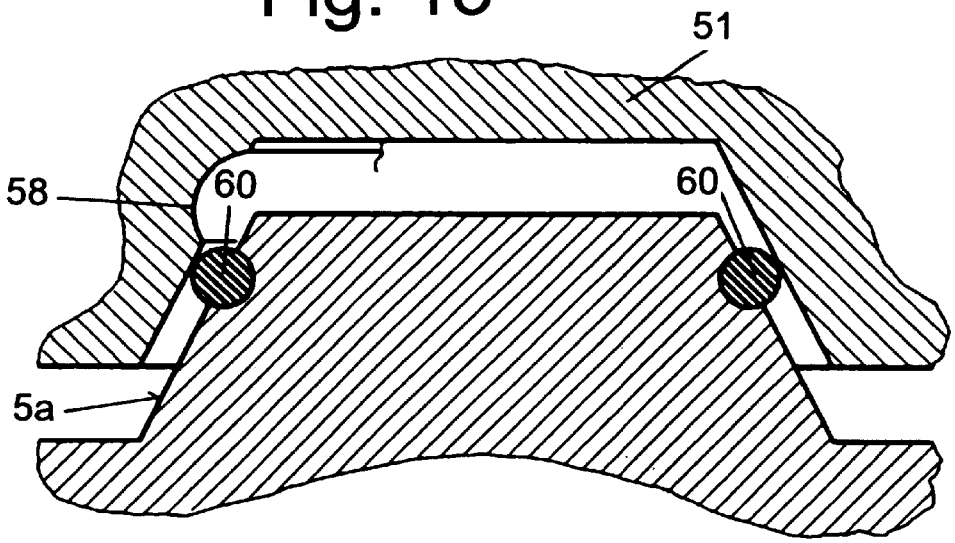
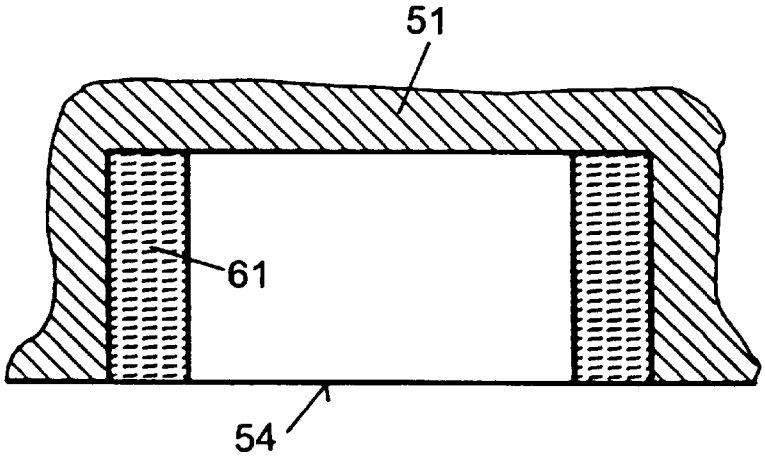
Fig. 14
Fig. 15
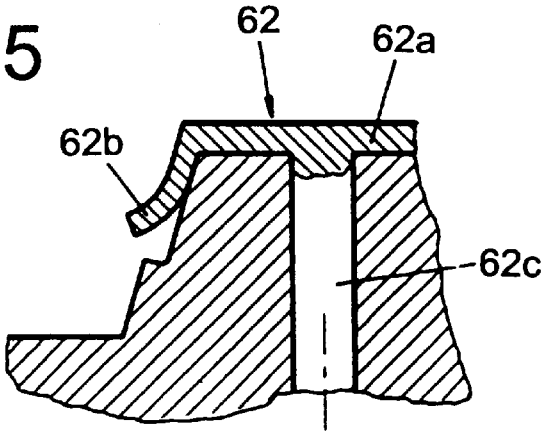

SEGMENT FOR LINING CAVITIES

BACKGROUND OF THE INVENTION

1. Field of the Invention

The present invention relates to a segment for lining cavities, in particular tunnels, which includes a substantially shell-shaped body bounded by an inner face, an outer face, and side faces, the latter exhibiting at least one opening for receiving a dowel.

2. The Prior Art

A frequently used technique in lining tunnels, shafts, etc., is tubbing. Individual tubbing segments are conveyed into the newly excavated tunnel where they are assembled to form a complete lining. To speed up installation and automatize the lining process, there is an increased use of tubbing segments with which an interlocking connection can be established between adjacent segments. Such a connection is often achieved by a dowel penetrating into a suitable bore in the adjacent segment.

A problem with connections of this kind is that, due to tolerances, measuring errors, etc., it will not always be possible to build or install the individual segments in such a way that the dowels are precisely aligned with the corresponding holes. For this reason allowances should be made for a certain radial displacement between the axis of the dowel and that of the bore into which the dowel is to be fitted, without any functional impairment.

In CH-A 654066 tunnel segments are disclosed which are joined by dowels. Different dowel variants are proposed which are to prevent the segments from falling apart once they have been fastened together. In order to avoid any damage while the dowels are being inserted into their openings, partially funnel-shaped elements are provided to facilitate assembly and prevent the holes and dowels from being damaged during fitting. There are no tolerances for compensating inaccuracies in the assembled state, however. As a consequence, problems are encountered with such segments in certain applications.

EP-A 100 771 describes an invention for connecting segments which is concerned with the above problem. The known connecting means substantially comprise sleeves into which the dowels are inserted so as to provide a force-mediated connection. To allow for variations in radial direction, the dowel sleeves are conical at their open ends, such that the dowels can undergo deformations in this area. This implies that the dowels must be made soft and flexible enough to permit such deformations. As a consequence, a large number of dowels are required to achieve a predetermined holding force. Moreover, this solution does not permit simple manufacture of the dowels, by pouring them as concrete elements integral with the body of the respective segment, for instance. It has further been found that the comparatively thin dowels of this type of construction frequently break upon insertion, thus leading to losses of material and delays in the lining process.

In DE-A 22 38 792 a tunnel lining is described in which the dowel holes are provided with spring rings. Such rings provide for a certain radial adjustment to compensate manufacturing tolerances. However, due to the spring characteristics and the essentially point-type contact between spring ring and dowel, the latter cannot be anchored securely in the segment.

Other solutions are disclosed in FR-A 78 25 472 and in DE-A 20 27 149. None of these solutions have proved completely satisfactory in practical use, however.

It is an object of the present invention to provide a segment of the above type which is easy to manufacture and to handle, and which offers a compensation in the instance of displacements in radial direction of the dowel.

In the invention this object is achieved by configuring the opening as a substantially cylindrical bore into which projects a tube of limited deformability, a gap being provided between the outer circumference of the tube and the wall of the bore.

An essential characteristic of the invention is the special configuration of the opening receiving the dowel. In principle, the invention is suited for assemblies of segments where any two segments to be fastened together are provided with corresponding openings, and where before installation a separately manufactured dowel is driven into one of these openings. According to the invention one of the two openings or both openings may be configured as specified in the invention. Moreover, one of the segments to be connected may include dowels which are moulded integral therewith and which are driven into the appropriately configured openings of the corresponding segment. It is a special advantage of the present invention that the dowel may be designed to suit any special requirements, and particularly, that the dowel may be made completely rigid.

On account of the substantially plastic deformation of the tube, the dowel will be anchored securely once the segments have been connected. Another advantage is that any movement of the tube in radial direction is limited by the wall of the bore, thus preventing any breaking or other damage even in the instance of faulty handling.

Manufacture of a segment of the invention is facilitated by placing a deformable material in the gap between bore and tube. During manufacture the deformable material acts as a lost casing, which will reduce production efforts and costs significantly.

Insertion of the dowel is facilitated by providing that the tube preferably end flush with the side face of the segment, its opening being flared in this area.

Satisfactory deformation of the tube may further be ensured by configuring the tube as a steel element which is embedded in the body of the segment, the depth of the bore exceeding the envisaged penetration depth of the dowel by at least 10 percent, and preferably by at least 20 percent, of the tube diameter. Special preference is given to a variant in which the gap has a width of 5 to 20 percent of the tube diameter.

The present invention is further concerned with an assembly of segments of the type described above, and a segment to be fastened thereto, which is provided with at least one dowel moulded integral with the body. As a result, a particularly stable connection is produced in a simple and cost-effective way.

A further advantage is gained by configuring the segments such that the dowel is provided substantially in one piece with and of the same material as the body of the segment. In this manner an interlocking connection is established utilizing the strength of the basic material. The manufacturing process itself is kept simple in this instance. A further increase in strength is achieved by providing reinforcing elements which extend from the body into the dowel.

BRIEF DESCRIPTION OF THE DRAWINGS.

The invention will now be further described with reference to the accompanying drawings, in which

FIG. 7 is a schematical axonometric representation of a segment of the invention;

FIG. 8 is a section through a part of a segment according to a further variant of the invention, with a dowel opening;

FIG. 9 is a section through a part of a segment, with a dowel;

FIGS. 12 and 13 show further variants of the invention, the representation corresponding to that of FIG. 11;

FIG. 14 shows a further variant of the invention, in a sectional view corresponding to FIG. 8;

FIGS. 15 and 16 show yet further variants of the invention, the sectional view corresponding to FIG. 9;

DETAILED DESCRIPTION OF THE PREFERRED EMBODIMENTS.

Figure 1:
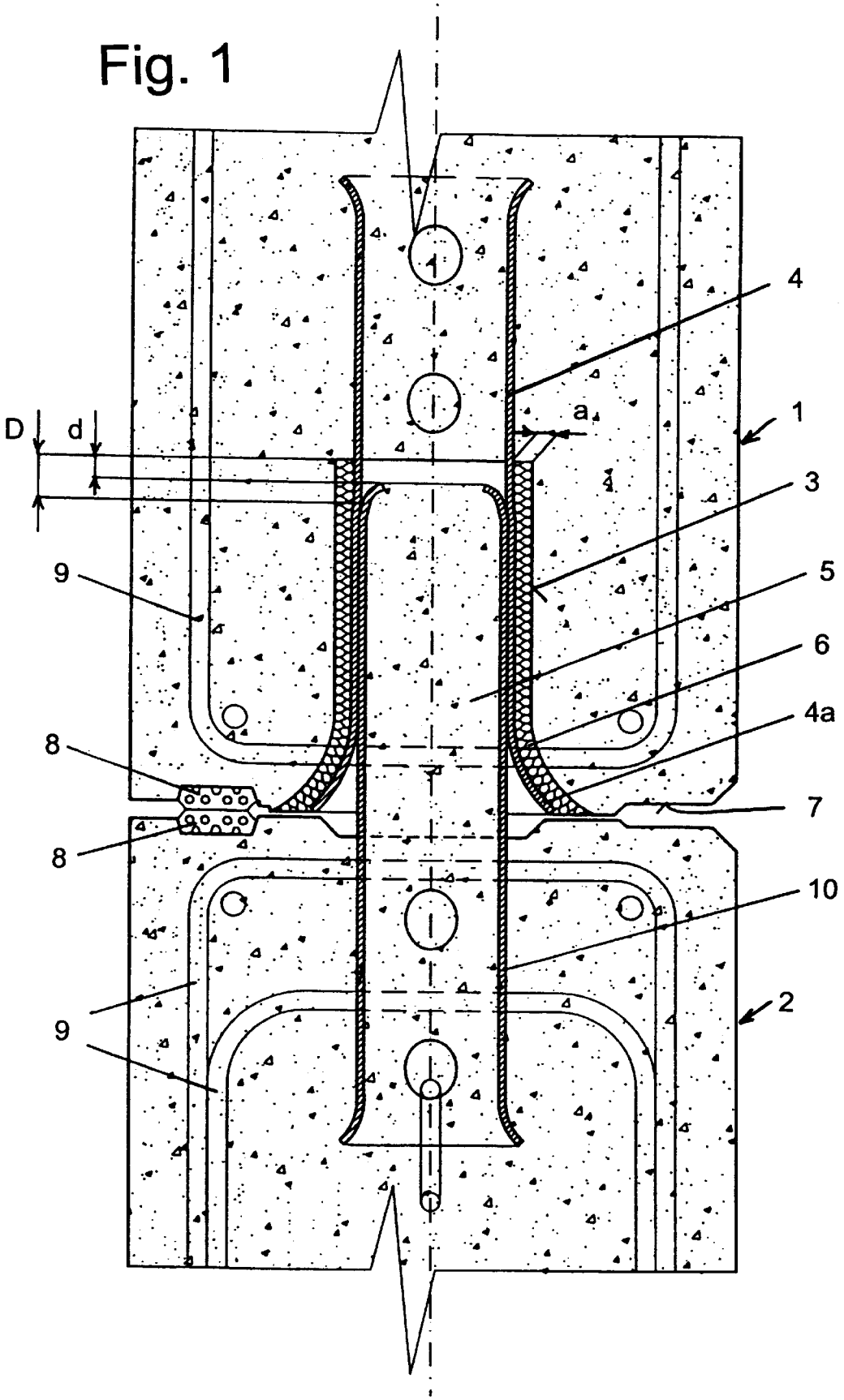
FIG. 1 is a partial section of two adjacent segments in the assembled state.

FIG. 1 shows a joint between a segment 1 provided with a bore or opening 3, and another segment 2 provided with a dowel 5. The bore 3 of segment 1 holds a tube 4, which is concentric with the bore 3. Since the exterior diameter of the tube 4 is smaller than the interior diameter of the bore 3, a gap a will remain between tube 4 and bore 3, which is filled with a layer 6 of deformable material. In the area of a side face 7 of segment 1 the tube 4 has a conical flare 4*a* in order to facilitate penetration of the dowel 5. The other end of tube 4 is anchored by embedding it in the body of the segment 1 made of concrete. Segments 1 and 2 are further provided with sealing elements 8 at their contact faces, and reinforcing elements 9 along their sides.

The dowel 5 is substantially configured as a concrete element which is made in one piece with the body of the segment 2, and is surrounded by a steel tube 10. This tube 10 projects into the body of the segment 2, thus anchoring the dowel 5.

The bore 3 is deeper than the length of the projecting part of dowel 5, such that a gap d is left in axial direction. Since the dowel 5 is rounded off at its front end, an area D is formed, within which a lateral displacement of tube 4 is permitted in radial direction.

Figure 2:
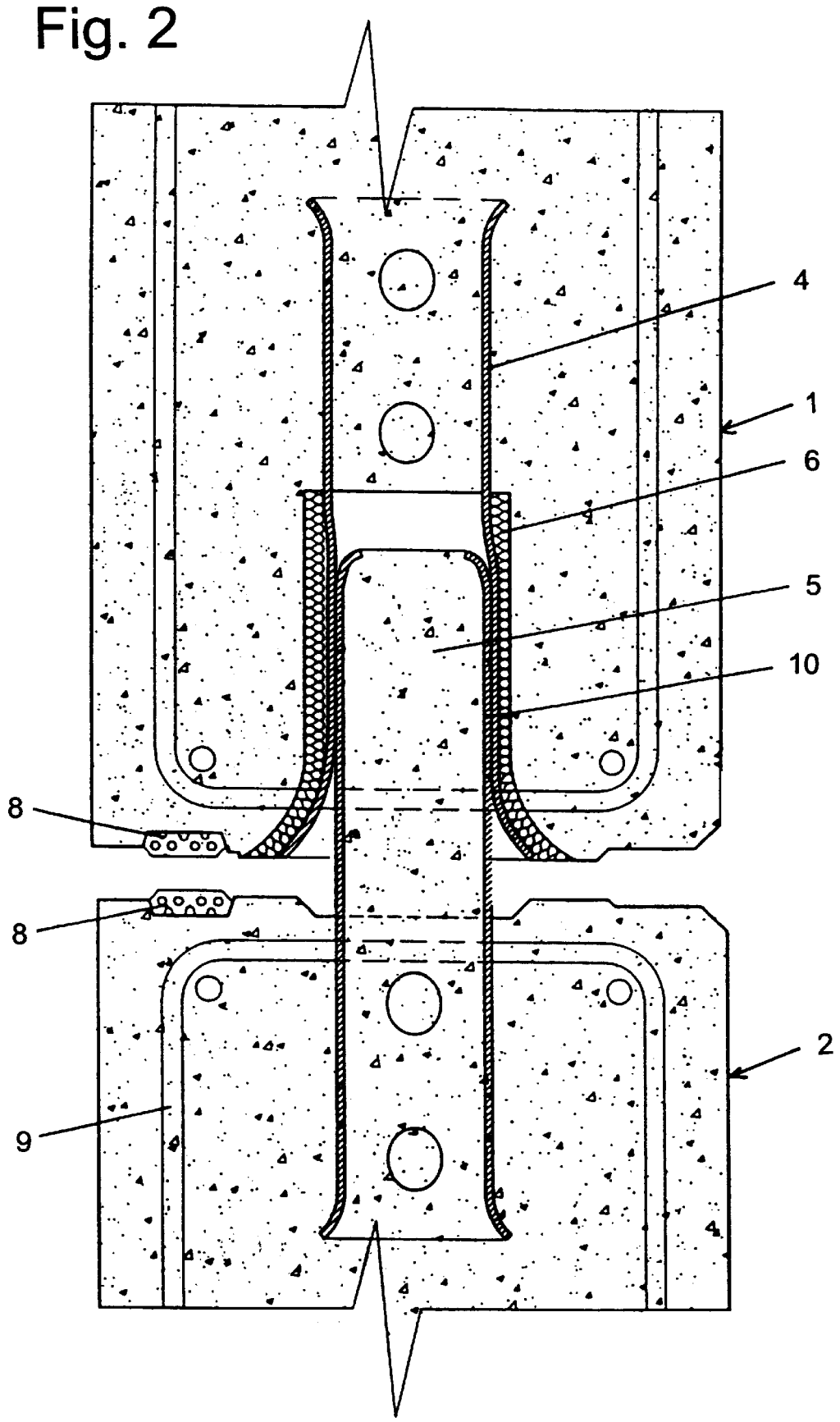
FIG. 2 shows the segments of FIG. 1 during assembly.

In FIG. 2 segments 1 and 2 are shown during joining, before the final position in the assembled state is reached. This figure also shows a lateral displacement between the two segments 1 and 2. In all other aspects FIG. 2 corresponds to FIG. 1.

Figure 4:
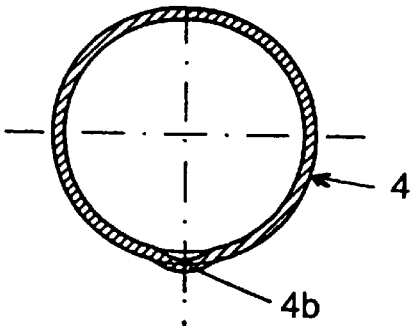
FIG. 4 is a schematical representation of the crosssection of the tube in the segment shown in FIG. 3.
Figure 3:
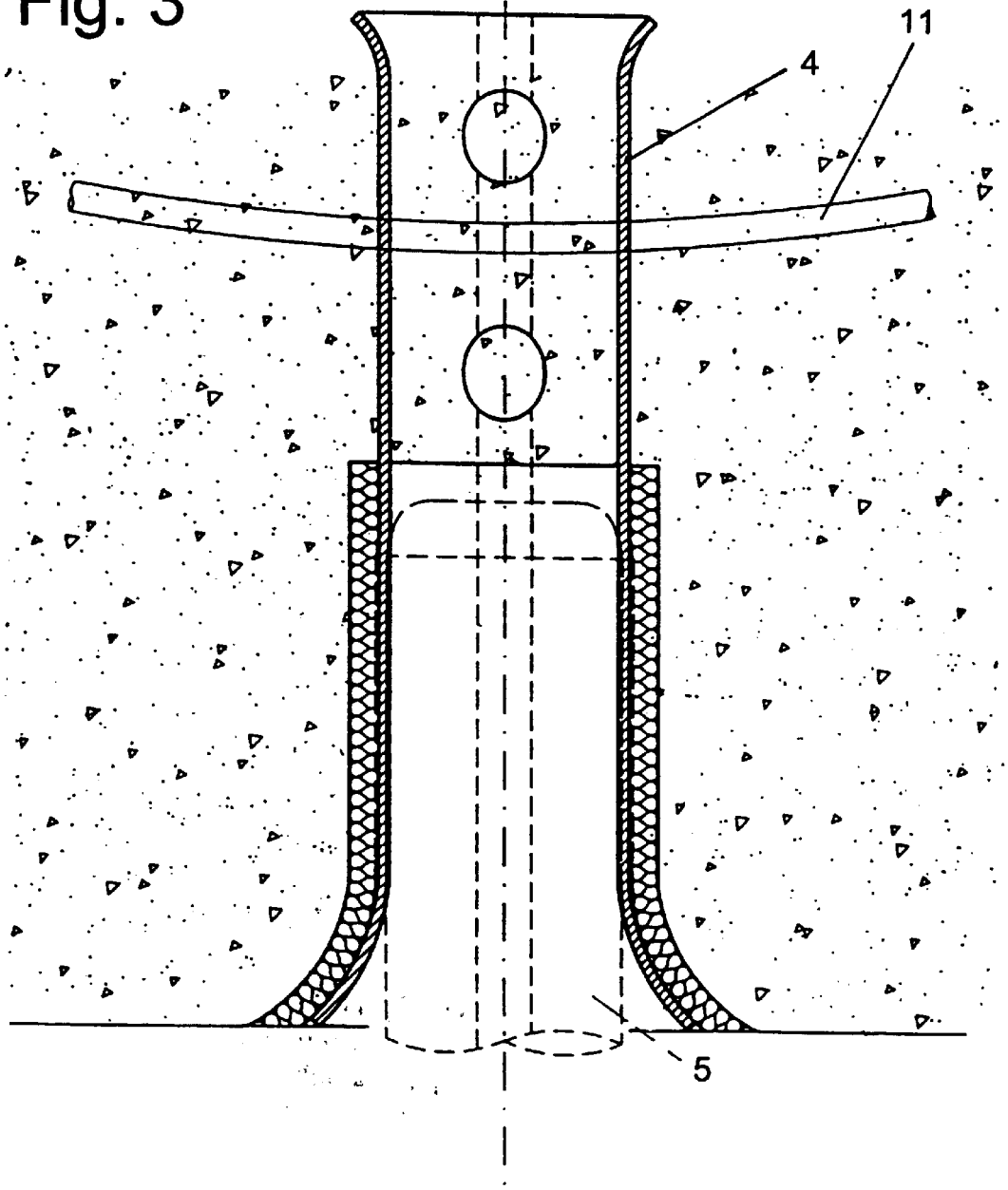
FIG. 3 is a partial section of a segment of the invention.

FIG. 3 gives a detailed view of a detail of segment 1 in FIG. 1. The dowel 5 entering tube 4 is represented by broken lines. This figure is designed to show the widening of the tube 4 by means of the dowel 5 and the force-mediated connection thus obtained. FIG. 3 further presents an anchoring element 11 for the tube 4. FIG. 4 shows a cross-section of tube 4, which latter is provided with a bead 4*b* in this variant. This bead 4*b* will facilitate deformation upon insertion of the dowel 5.

Figure 6:
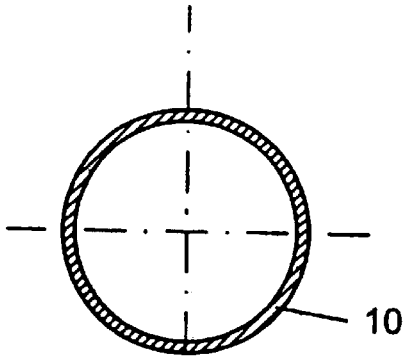
FIG. 6 shows a cross-section of the sleeve tube of the dowel in the segment of FIG. 5, in a schematical representation.
Figure 5:
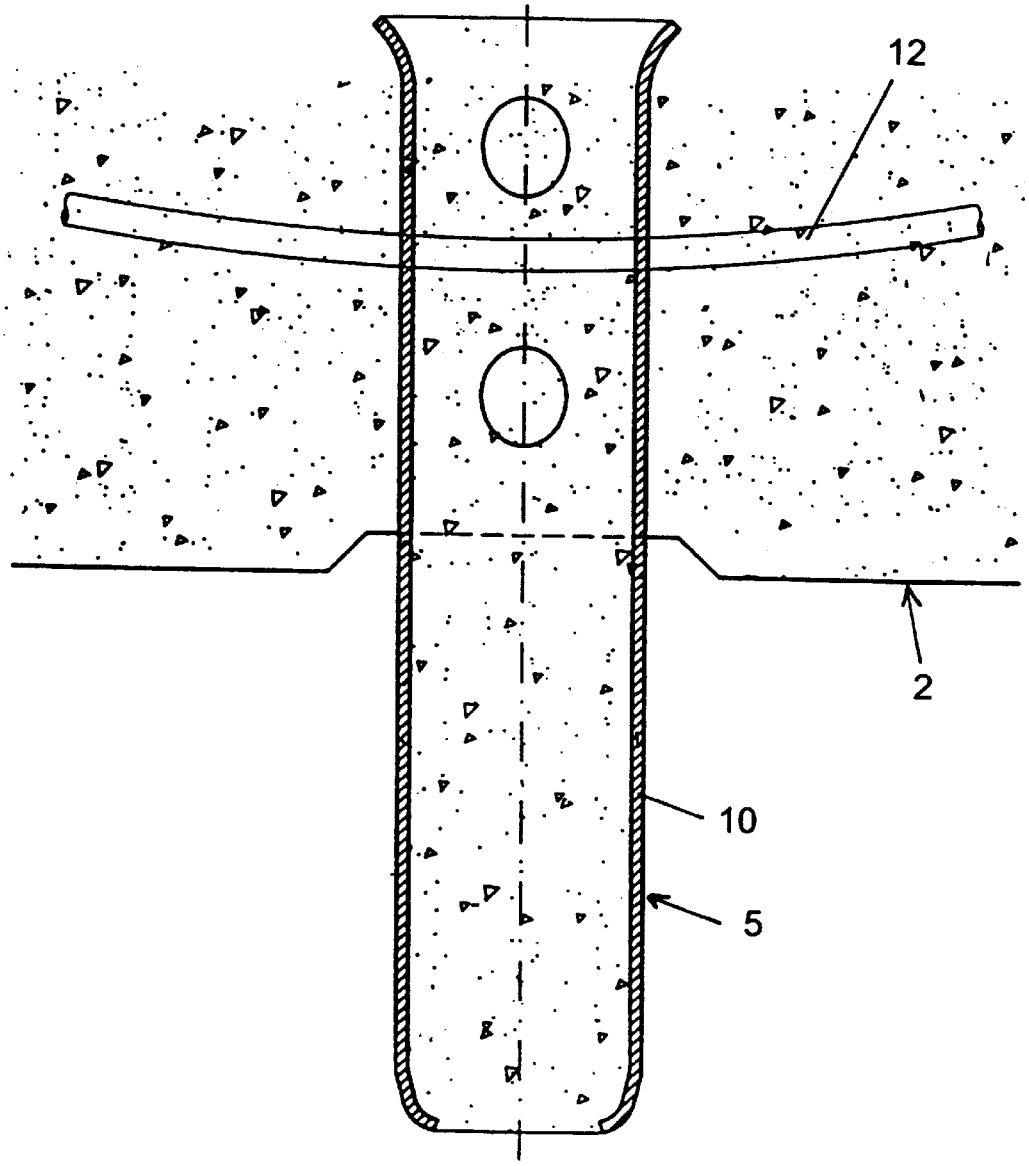
FIG. 5 is a partial section of a segment and a dowel made in one piece.

FIG. 5 gives a detailed view of a dowel 5 in a segment 2, a reinforcing element 12 being provided for anchoring the tube 10 of the dowel 5. As can be seen in FIG. 6, the tube 10 has a circular cross-section.

FIG. 7 gives a general view of the configuration of a segment as described by the invention. The segment 1 comprises a body 20 of hexagonal shape, which is bounded by six side faces 21. The outer face 22 of the segment 1 is convex, whereas the inner face 23 is concave. On one side face 21 are provided two dowels 5, which are configured as described above. The corresponding face on the opposite side is provided with two openings 3, which are positioned at the same distance of each other as the dowels 5, and are configured as described by the invention, in accordance with FIGS. 1 and 2. Segments of this particular configuration may be assembled in honeycomb fashion, thus offering great dimensional stability.

FIGS. 8 and 9 give a general view of the dowel opening 54 and the dowel 5 itself. The opening 54 is formed by a conical wall 54*a* which is bounded by a bottom 54*b*. The dowels 5 also have a conical wall Sa and a top face 5*b*.

Figure 10:
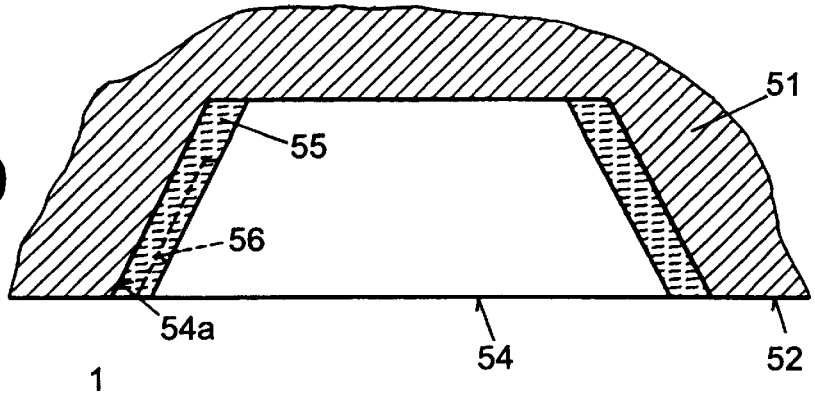
FIG. 10 shows a variant of the invention, in a sectional view corresponding to FIG. 8.

In the variant shown in FIG. 10 the conical wall 54*a* of the opening 54 is provided with a lining 55 of flexible plastic material, which is compressed when the dowel 5 is inserted, as is indicated by the broken line 56. In this way tolerances and other variations can be compensated to a degree. This is of particular relevance in applications with a curved tunnel axis, where precise positioning of the individual segments is extremely difficult.

Figure 11:
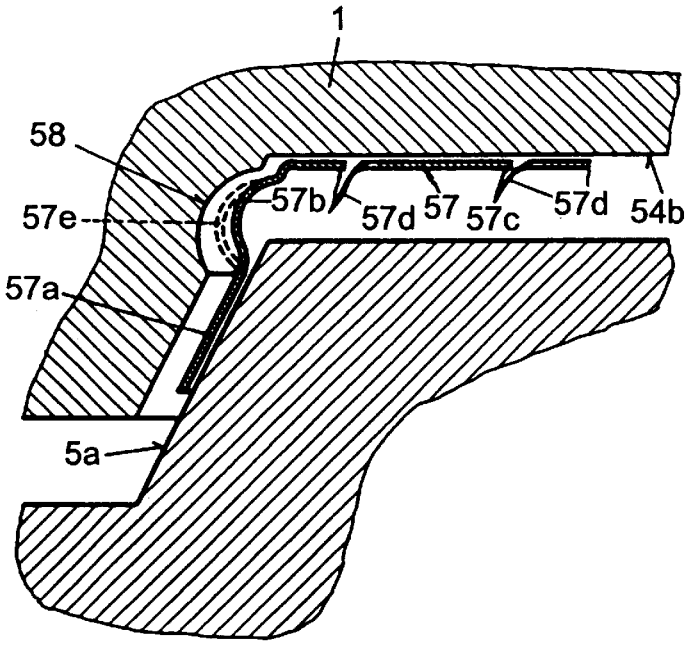
FIG. 11 shows a dowel of a segment penetrating into an opening.

FIG. 11 presents a preferred variant of a locking element 57. The locking element 57 is made of thin sheet-metal and comprises a conical part 57*a* which is fastened to the conical side wall 5*a* of the dowel 5. The conical part 57*a* is followed by a projecting zone 57*b* carrying an essentially plane cover plate 57*c*. Into the projecting zone 57*b* radial slits 57*d* are cut at certain distances to facilitate deformation. When the dowel 5 is inserted into its opening 54 a point is reached at which plate 57*c* touches the bottom 54*b*. This situation is illustrated in FIG. 11. Upon further penetration of the dowel the projecting zone 57*b* will bulge, as is indicated in the drawing by broken lines 57*e*. The bulged part 57*e* will enter an annular groove 58, which is provided in the conical wall 54*a*. As a consequence, a lock is achieved, which will enable the connection between the two segments to accommodate tensile forces to a certain extent.

Figure 12:
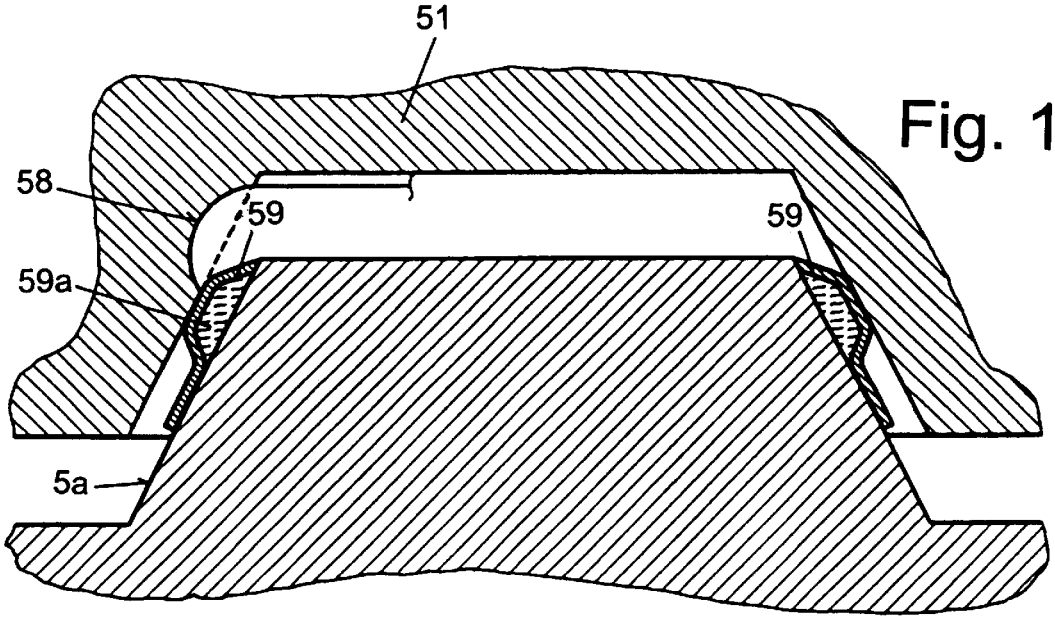

Other variants of a lock are shown in FIG. 12. An elastic locking element 59 is attached to the conical wall 5*a* of the dowel 5. Inside a projection a pad 59*a* is provided, which is made of compressible material, such as foam rubber. In the position shown in FIG. 12 the pad 59*a* is compressed by the wall 54*a*. If an annular groove 58 is provided in the conical wall 54*a*, as is indicated in the left half of FIG. 12, an essentially interlocking connection is formed as the locking element 59 locks with the groove 58 upon further penetration of the dowel 5. If no groove 58 is provided, as in the right half of FIG. 11, the locking effect is considerably weaker, but lateral displacements between dowel 5 and dowel opening 54 may be compensated to a greater extent.

FIG. 13 shows a ring 60 which sits on a dowel and can serve as a locking element. In analogy to FIG. 11 such a ring 60 may be combined with a dowel opening 54 with or without groove 58. The ring 60 is made of rubber. If metal is used for the ring in an alternative variant, the ring should be cut open and a groove 58 should be provided. It would further be possible to insert the ring into a groove in the dowel opening 54 such that it will lock with a corresponding groove in the dowel 5.

FIG. 14 presents another variant of a dowel opening 54, which is essentially cylindrical in shape and has a cylindrical lining 61. Upon insertion of the conical dowel 5 the lining 61 is deformed, and a reliable press fit is obtained.

FIG. 15 shows a locking variant. The locking element 62 comprises a cover plate 62*a* with outward projections 62*b* along its circumference. These projections 62*b* lock with a corresponding shoulder (not shown here) in the dowel opening 54, thus keeping the dowel 5 securely in place. An integrally moulded anchoring element 62*c* projecting from the middle of the cover plate 62*a* serves as a reinforcement for the dowel 5.

Figure 16:
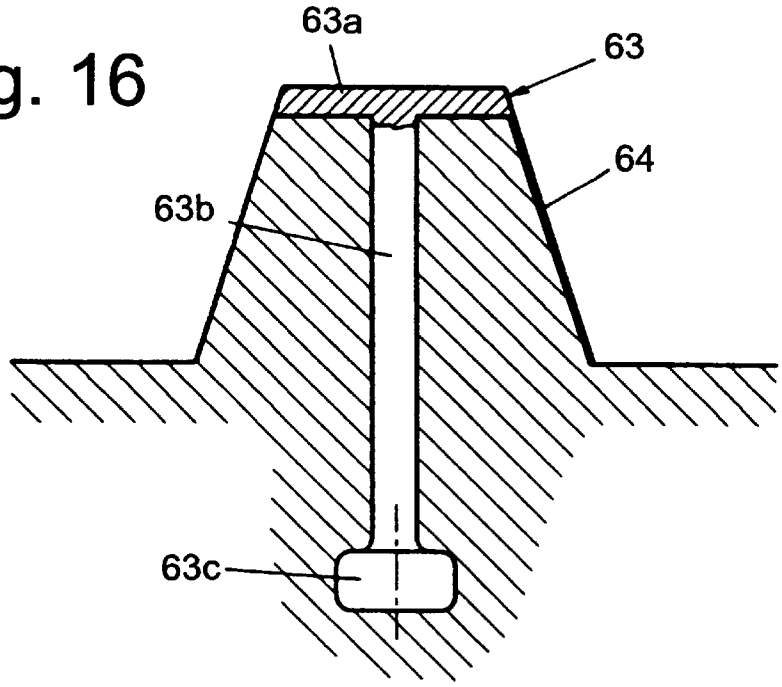

Another kind of reinforcement is shown in FIG. 16. The reinforcing element 63 comprises a cover plate 63*a*, a rod 63*b* and an anchor 63*c* inside the body 51. The conical surface of the dowel 5 is provided with a plastic cover 64.

Figure 17:
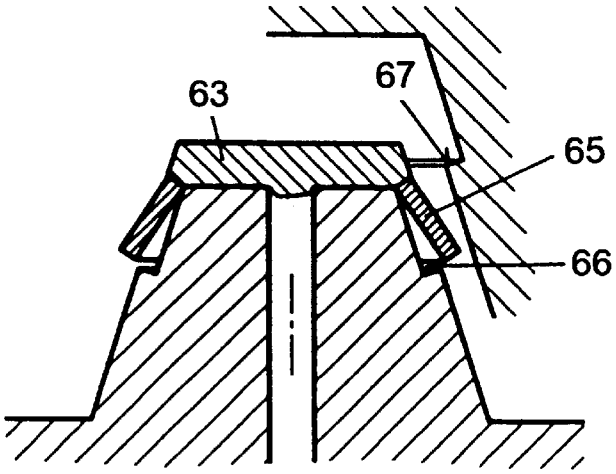
FIGS. 17 and 18 show further variants of the invention, the sectional view corresponding to FIG. 11.

FIG. 17 presents a reinforcing element similar to that in FIG. 15, which extends beyond the rim of the dowel 5, to hold a spring washer 65 projecting from an annular recess 66 on the dowel 5. When the dowel is driven in the spring washer 65 is pressed radially inwards, elastically pressing against the dowel opening 54. In the assembled state the washer rests against a shoulder 67 of the dowel opening 54.

Figure 18:
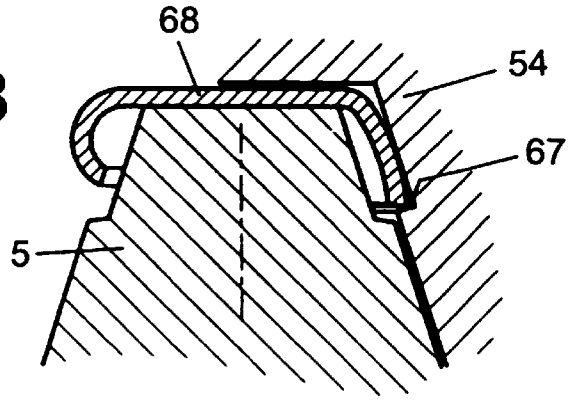

FIG. 18 shows another locking element 68. In the left half of FIG. 18 this locking element is shown in its original state, in which a bulged crown extends outwardly. During assembly this crown is pressed radially inwards, such that its rim will rest against a shoulder 67 of the dowel opening 54.

The present invention has proved particularly robust, both as regards damaging the segments during handling, and with respect to tolerances and inaccuracies, which will not interfere with the stability and permanence of the assembled segments.

We claim:

1. Segment for lining cavities, in particular tunnels, comprising a substantially shell-shaped body defining an inner face, an outer face and a plurality of side faces, one of said plurality of side faces providing a substantially cylindrical opening; and a tube of limited deformability having a first portion which is embedded in said body and filled by said body, and a second portion which extends from said first portion within said opening towards said side face, said tube having an outer diameter which is smaller than a diameter of said opening so as to define an annular gap therebetween, said annular gap containing a deformable material, and said second portion of said tube being empty and adapted to receive a dowel of another segment for connection thereto.

2. Segment as in claim 1, wherein the second portion of said tube includes an end which is substantially flush with the side face, and wherein said opening is flared in an area of said side face.

3. Segment as in claim 1, wherein the tube is made of steel.

4. Segment as in claim 1, wherein a depth of the opening exceeds a penetration depth of the dowel by at least 10 percent of a diameter of the tube.

5. Segment as in claim 1, wherein a depth of the opening exceeds a penetration depth of the dowel by at least 20 percent of a diameter of the tube.

6. Segment as in claim 1, wherein said gap has a width cof 5 to 20 percent of a diameter of the tube.

7. Segment as in claim 1, wherein said segment is provided with a dowel opening and a dowel which is made substantially in one piece with and of the same material as the body of the segment.

8. Segment as in claim 7, wherein the dowel includes a reinforcing element which extends into the body.

9. Segment as in claim 7, wherein the dowel is substantially configured as a truncated cone.

10. Segment as in claim 7, wherein the dowel includes a locking element to enhance locking with a corresponding dowel opening of another segment.

11. Segment as in claim 10, wherein the locking element is attached to the outside of the dowel and has a deformable part which engages in a recess in the corresponding dowel opening when the dowel penetrates into said corresponding dowel opening.

12. Segment as in claim 10, wherein the locking element includes a spring element which locks with a corresponding recess in the corresponding dowel opening when the dowel penetrates into said corresponding dowel openning.

13. Segment as in claim 7, wherein a locking element is provided in the dowel opening to enhance locking with a corresponding dowel of another segment.

14. Segment as in claim 7, including a flexible lining in the dowel opening.

15. Segment as in claim 7, wherein the dowel includes a cover element which is connected to a reinforcing element or is molded integral therewith.

16. Segment as in claim 7, wherein the body is of substantially hexagonal configuration, and wherein at least two dowels are provided on one side face, and a corresponding number of dowel openings are provided on the opposite side face.

17. Segment as in claim 16, wherein guiding elements are provided in at least one other side face which are designed to lock in corresponding grooves in a side face of an adjacent segment.

18. Assembly of segments, including a segment according to claim 1, and a segment to be fastened thereto which is provided. with at least one dowel molded integral with the body.

19. Assembly as in claim 18, wherein the dowel is surrounded by a steel tube which is partly embedded in the body of the segment.

* * * * *

UNITED STATES PATENT AND TRADEMARK OFFICE

CERTIFICATE OF CORRECTION

PATENT NO. : 5,992,118

DATED : November 30, 1999

INVENTOR(S) : Harald WAGNER et al.

It is certified that error appears in the above-identified patent and that said Letters Patent is hereby corrected as shown below:

On the title page: Item

[73] Assignee: GIT Tunnelbau GmbH, Pasching, Austria

Signed and Sealed this

Twenty-third Day of May, 2000

*Attest:*

Q. TODD DICKINSON

*Attesting Officer*

*Director of Patents and Trademarks*